US009970654B2

(12) United States Patent
Kim et al.

(10) Patent No.: US 9,970,654 B2
(45) Date of Patent: May 15, 2018

(54) COMBUSTION DEVICE FOR IMPROVING TURNDOWN RATIO

(71) Applicant: KYUNGDONG NAVIEN CO., LTD., Pyeongtaek-si, Gyeonggi-do (KR)

(72) Inventors: Hyoung Rae Kim, Suwon-si (KR); Seung Kil Son, Bucheon-si (KR)

(73) Assignee: KYUNGDONG NAVIEN CO., LTD, Pyeongtaek-si (KR)

( * ) Notice: Subject to any disclaimer, the term of this patent is extended or adjusted under 35 U.S.C. 154(b) by 657 days.

(21) Appl. No.: 14/396,314

(22) PCT Filed: Apr. 15, 2013

(86) PCT No.: PCT/KR2013/003120
§ 371 (c)(1),
(2) Date: Nov. 24, 2014

(87) PCT Pub. No.: WO2013/162197
PCT Pub. Date: Oct. 31, 2013

(65) Prior Publication Data

US 2015/0086931 A1 Mar. 26, 2015

(30) Foreign Application Priority Data

Apr. 23, 2012 (KR) ..... 10-2012-0042067

(51) Int. Cl.
*F23D 14/62* (2006.01)
*F23D 14/08* (2006.01)
(Continued)

(52) U.S. Cl.
CPC ..... *F23D 14/08* (2013.01); *F23D 14/60* (2013.01); *F23D 14/62* (2013.01); *F23D 14/64* (2013.01);
(Continued)

(58) Field of Classification Search
CPC ..... F02M 9/02; F02M 9/023; F02M 9/026; F02M 9/04; F02M 9/06; F02M 9/065;
(Continued)

(56) References Cited

U.S. PATENT DOCUMENTS 4,044,077 A * 8/1977 Gupta ..... F02M 9/02 123/590
2010/0047728 A1 2/2010 Kim ..... 431/89
(Continued)

FOREIGN PATENT DOCUMENTS

CN 1497211 A 5/2004
DE 3028852 A1 * 2/1982 ..... F02M 9/06
(Continued)

OTHER PUBLICATIONS

DE 3028852 A1—English machine translation.*
International Search Report dated Jul. 9, 2013, issued to corresponding International Application No. PCT/KR2013/003120.

*Primary Examiner* — Jorge Pereiro
(74) *Attorney, Agent, or Firm* — Stein IP, LLC

(57) ABSTRACT

The purpose of the present invention is to provide a combustion device for improving a turndown ratio, which is capable of stably implementing a combusted state in a low-output load region by improving a turndown ratio of a burner. To this end, the present invention provides the combustion device having a premixing chamber (300) which is connected to an air supply tube (100) and a gas supply tube (200), and which has a space for premixing air and gas provided therein, wherein the space for premixing the air and gas supplied from the air supply tube (100) and the gas supply tube (200) is divided into multiple stages of a venturi structure in the premixing chamber (300), and the discharging direction of the gas discharged inside the premixing chamber (300) through the gas supply tube (200) is formed
(Continued)

in parallel to the flow direction of the gas supplied inside the premixing chamber (300) through the air supply tube (100).

3 Claims, 6 Drawing Sheets

(51) Int. Cl.
*F23D 14/60* (2006.01)
*F23D 14/64* (2006.01)
*F23N 1/02* (2006.01)

(52) U.S. Cl.
CPC ..... *F23N 1/027* (2013.01); *F23D 2203/007* (2013.01); *F23D 2900/00003* (2013.01)

(58) Field of Classification Search
CPC ..... F02M 11/08; F23D 14/02; F23D 14/60; F23D 14/62
See application file for complete search history.

(56) References Cited

U.S. PATENT DOCUMENTS

| | | | | |
|---|---|---|---|---|
| 2011/0139045 | A1 | 6/2011 | Zatti et al. | 110/188 |
| 2013/0213378 | A1* | 8/2013 | Schultz | F24H 3/08 126/110 C |

FOREIGN PATENT DOCUMENTS

| | | | |
|---|---|---|---|
| EP | 0 896 192 | A2 | 2/1999 |
| JP | S 59-200118 | A | 11/1984 |
| KR | 10-2004-0035369 | A | 4/2004 |
| KR | 10-0805630 | B1 | 2/2008 |
| KR | 10-2010-0020084 | A | 2/2010 |
| KR | 10-2010-0050769 | A | 5/2010 |
| KR | 10-2011-0022433 | A | 3/2011 |
| WO | WO 2012/007823 | A1 | 1/2012 |

* cited by examiner

COMBUSTION DEVICE FOR IMPROVING TURNDOWN RATIO

CROSS-REFERENCE TO RELATED APPLICATIONS

This application is a national stage of International Application No. PCT/KR2013/003120, filed Apr. 15, 2013, which claims the benefit of priority to Korean Application No. 10-2012-0042067, filed Apr. 23, 2012, in the Korean Patent Office. All disclosures of the documents named above are incorporated herein by reference.

BACKGROUND OF THE INVENTION

1. Field of the Invention

The present invention relates to a combustion device for improving a turndown ratio, and more particularly, to a combustion device for improving a turndown ratio, in which a venturi structure is designed into multiple stages, and the venturi configuration varies to improve a turndown ratio, as well as, when the air and gas are premixed with each other in a premixing chamber, a passage of gas and air is formed so that the gas is discharged in the same direction as a flow direction of the air to stably implement a combustion state even at a low-output load region.

2. Description of the Related Art

In general, a turndown ratio (TDR) of a burner is set for gas combustion devices such as gas boilers or gas water heaters. The TDR refers to a 'ratio of the maximum gas consumption to the minimum gas consumption' in a gas combustion device in which a gas amount is variably regulated. For example, when the maximum gas consumption is 30,000 kcal/h, and the minimum gas consumption is 6,000 kcal/h, the TDR becomes 5:1. The TDR may be limited according to the lowest adjustable level of the minimum gas consumption in order to maintain stable flame.

In the case of the gas combustion device, convenience in use during a heating and hot-water operation increases as the TDR increases. That is, initial combustion is performed with a maximum thermal power to reach a desired heating temperature within a short time. However, when the heating temperature reaches close to the desired heating temperature, an amount of gas supplied into a burner may be reduced to perform the combustion. Here, when the TDR is less due to the high minimum gas consumption, it is difficult to control the reduction of the gas amount so as to reduce the output of the burner.

In particular, when the burner operates in low heating and hot-water load region, the combustion device may be frequently turned on/off, and thus the combustion state may be unstable. As a result, a variation in a temperature control increases to deteriorate durability of the device. Therefore, methods for improving the TDR of the burner that are applied to combustion devices have been proposed.

As the related prior art, Korean Patent Registration No. 10-0805630 discloses a combustion device for a gas boiler that includes a blower for supplying air required for combustion, a proportional control valve for regulating a flow rate of supplied gas, a nozzle unit connected to the proportional control valve to supply a gas through an opening/closing of an auxiliary valve, the nozzle unit including a plurality of nozzles that are connected in parallel to each other, a mixing chamber in which the air supplied from the blower and the gas passing through the nozzle unit are mixed with each other to supply the mixture onto a surface of the burner, and a control unit for controlling the number of revolution of the blower through an opening/closing of the proportional control valve and the auxiliary valve to supply only a required amount of air for combustion.

According to the above-described constitutions, there is an advantage in that the nozzles of the nozzle unit into which the gas is supplied are parallely disposed in multiple stages, and the opening/closing of each of the nozzles is controlled to correspond to an output of the burner to improve a turndown ratio, thereby enhancing combustion stability in a low-output load region.

However, in conventional combustion devices in addition to the prior art, a relationship between flow directions of air and gas when the air and gas are mixed with each other in the mixing chamber (premixing chamber) and combustion efficiency have not been considered. In the conventional combustion devices, the flow direction of the air and the discharge direction of the gas in the premixing chamber are different from each other to mix the air and the gas with each other. Thus, when the gas is discharged in a direction different from the flow direction of the air to mix the gas with the air, the gas discharge is effected by the air flow. As a result, it may be difficult to obtain a desired air/gas ratio, and thus unstable combustion may occur to deteriorate low combustion efficiency.

Also, since the premixing chamber of the conventional combustion device has a single venturi structure, the TDR is limited to a ratio of 5:1 or less. Thus, when burned in a low-output load region, the burner may be frequently turned on/off to deteriorate the combustion efficiency, thereby deteriorating the performance of the combustion device.

SUMMARY OF THE INVENTION

Technical Problem

To solve the above-described problem, an object of the present invention is to provide a combustion device for improving a turndown ratio, which is capable of stably implementing a combustion state in a low-output load region to improve a turndown ratio of a burner.

It is another object of the present invention is to provide a combustion device which is capable of minimizing a variation in mixing ratio of air and gas when a flow rate of a mixed gas is regulated according to load intensity to improve combustion efficiency.

It is further another object of the present invention is to provide a combustion device for improving a turndown ratio, which is capable of simplifying a structure in a device for controlling a flow rate of a mixed gas according to a heating or hot-water load.

Technical Solution

To implement the above-described objects, a combustion device for improving a turndown ratio includes a premixing chamber 300 communicating with an air supply tube 100 and a gas supply tube 200, the premixing chamber 300 having a space in which air and gas for combustion are mixed with each other, wherein the inner space of the premixing chamber 300, in which the air and gas supplied through the air supply tube 100 and the gas supply tube 200 are mixed with each other is divided into a multiple-stage venturi structure, and the gas discharged into the premixing chamber 300 through the gas supply tube 200 is discharged in parallel to a flow direction of the air supplied into the premixing chamber 300 through the air supply tube 100.

In this case, the combustion device may further include a mixed gas regulation unit 400 that opens or closes a portion of the premixing chamber 300 divided into the multiple stages to regulate a flow rate of a mixed gas of the air and gas.

Also, the premixing chamber 300 may be divided into two stages to form a first premixing chamber 310 and a second premixing chamber 320 in both sides of a partition member 301, and the mixed gas regulation unit 400 may open or close the second premixing chamber 320 through/into which the air passes and the gas is discharged.

Also, the gas supply tube 200 may be branched into a first gas discharge tube 210 supplying the gas into the first premixing chamber 310 and a second gas discharge tube 220 supplying the gas into the second premixing chamber 320, and a first discharge hole 211 of the first gas discharge tube 210 and a second discharge hole 221 of the second gas discharge tube 220 may be formed so that the gas is discharged toward outlets 312 and 322 of the first premixing chamber 310 and the second premixing chamber 320.

Also, the first and second gas discharge tubes 210 and 220 may be disposed to transversely cross a middle portion of the first premixing chamber 310 and the second premixing chamber 320, respectively, and a flow path of the air may be formed around each of the first gas discharge tube 210 and the second gas discharge tube 220.

Also, the mixed gas regulation unit 400 may include a moving block 420 reciprocated by a driving unit 410 to open or close a flow path of the air passing through the second discharge hole 221 of the second gas discharge tube 220 and the second premixing chamber 320.

Also, the driving unit 410 may include a step motor or a solenoid.

Also, the first discharge hole 211 of the first gas discharge tube 210 and the second discharge hole 221 of the second gas discharge tube (220) may be formed in throat portions in the first premixing chamber 310 and the second premixing chamber 320, respectively.

Advantageous Effects

In the combustion device for improving the turndown ratio according to the present invention, the inside of the premixing chamber may be partitioned into the multiple-stage venturi structure, and the gas may be discharged in the same direction as the flow direction of the air to realize the turndown ratio of 10:1 or more, thereby implementing the stable combustion state even in the low heating or hot-water load region. In addition, when the flow rate of the mixed gas is regulated, the variation in mixing ratio of the air and gas may be minimized to improve the combustion efficiency and minimize the generation of the pollutants.

Also, according to the present invention, a portion of the premixing chamber may be opened or closed by the moving block that is reciprocated by the driving unit to regulate the flow rate of the mixed gas air and gas according to the output of the burner, thereby simplifying the device for regulating the flow rate of the mixed gas.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

[Description of the Reference Symbols]

| | |
|---|---|
| 100: Air supply tube | 200: Gas supply tube |
| 210: First gas discharge tube | 211: First gas discharge hole |
| 220: Second gas discharge tube | 221: Second gas discharge hole |
| 230, 260: O-ring | 240: Orifice |
| 250: Packing | 300: Premixing chamber |
| 301: Partition member | 310: First premixing chamber |
| 311, 321: Inlet | 312, 322: Outlet |
| 320: Second premixing chamber | 330: Moving block guide part |
| 400: Mixed gas regulation unit | 410: Driving unit |
| 420: Moving block | 430: Support rod |

DESCRIPTION OF THE EMBODIMENTS

Hereinafter, a constitution and operation of preferable embodiments according to the present invention will be described in detail with reference to the accompanying drawings.

Figure 1:
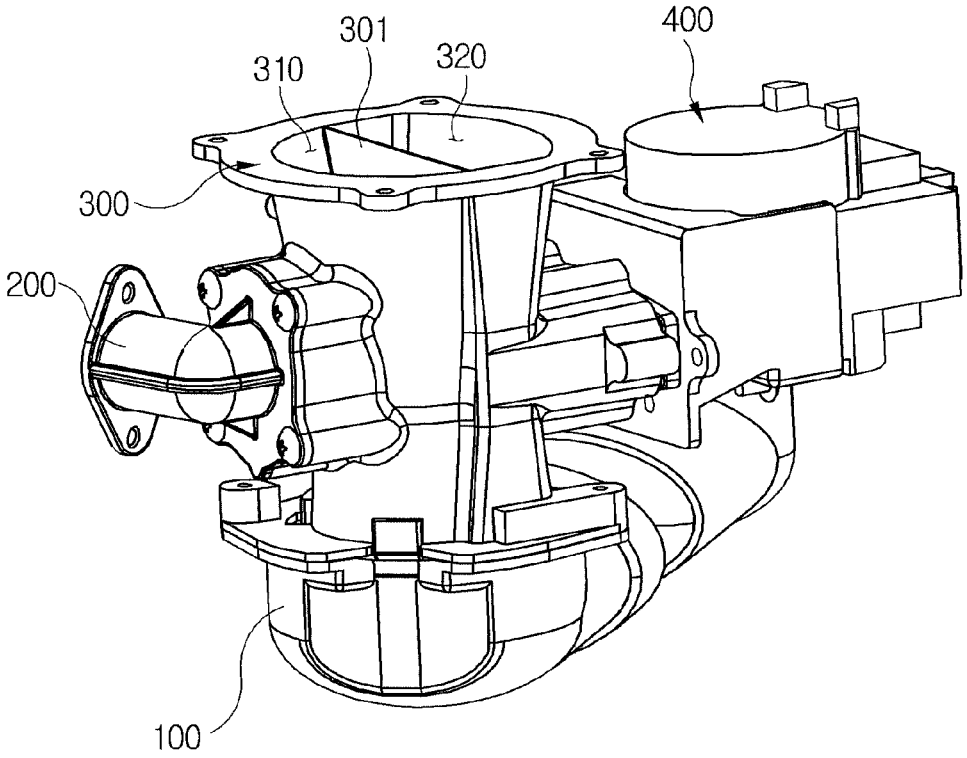
FIG. 1 is a perspective view illustrating an exterior of a combustion device for improving a turndown ratio according to the present invention.
Figure 2:
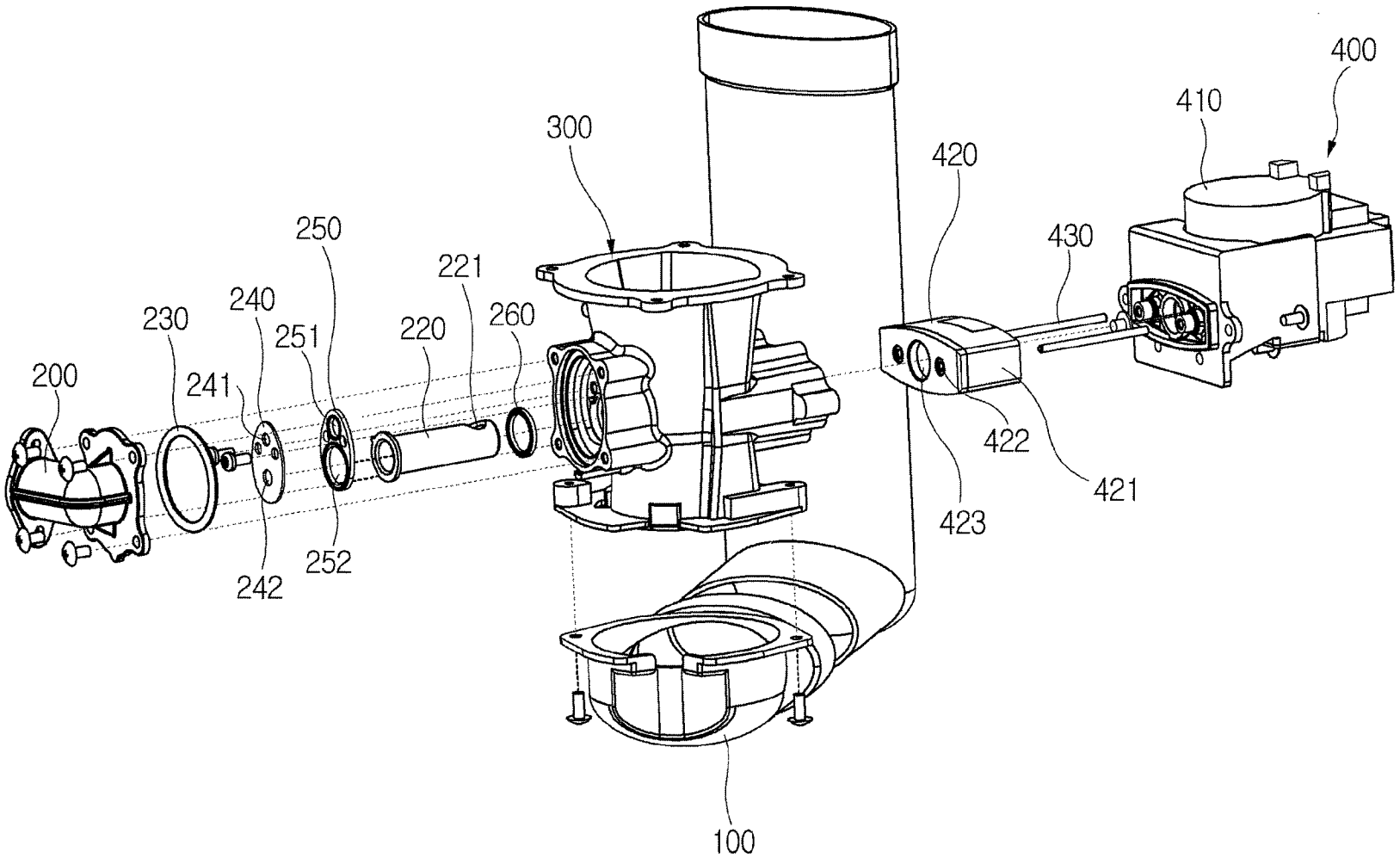
FIG. 2 is an exploded perspective view of FIG. 1.

FIG. 1 is a perspective view illustrating an exterior of a combustion device for improving a turndown ratio according to the present invention, and FIG. 2 is an exploded perspective view of FIG. 1.

A combustion device according to the present invention includes a premixing chamber 300 in which air and gas for combustion are premixed, an air supply tube 100 connected to a lower portion of the premixing chamber 300, a gas supply tube 200, through which the gas for combustion is supplied, connected at one side of the premixing chamber 300, and a mixed gas regulation unit 400, which regulates flow rates of the air and gas that flows into the premixing chamber 300 to a flow rate in a mixed gas, disposed at the other side of the premixing chamber 300.

The air supply tube 100 transfers external air that is sucked by rotation of a blower (not shown) into the premixing chamber 300.

The premixing chamber 300 has a space having a venturi structure, in which air introduced along the air supply tube 100 and gas supplied from the gas supply tube 200 and then discharged are premixed, i.e, has a structure partitioned into multiple stages.

Figure 3:
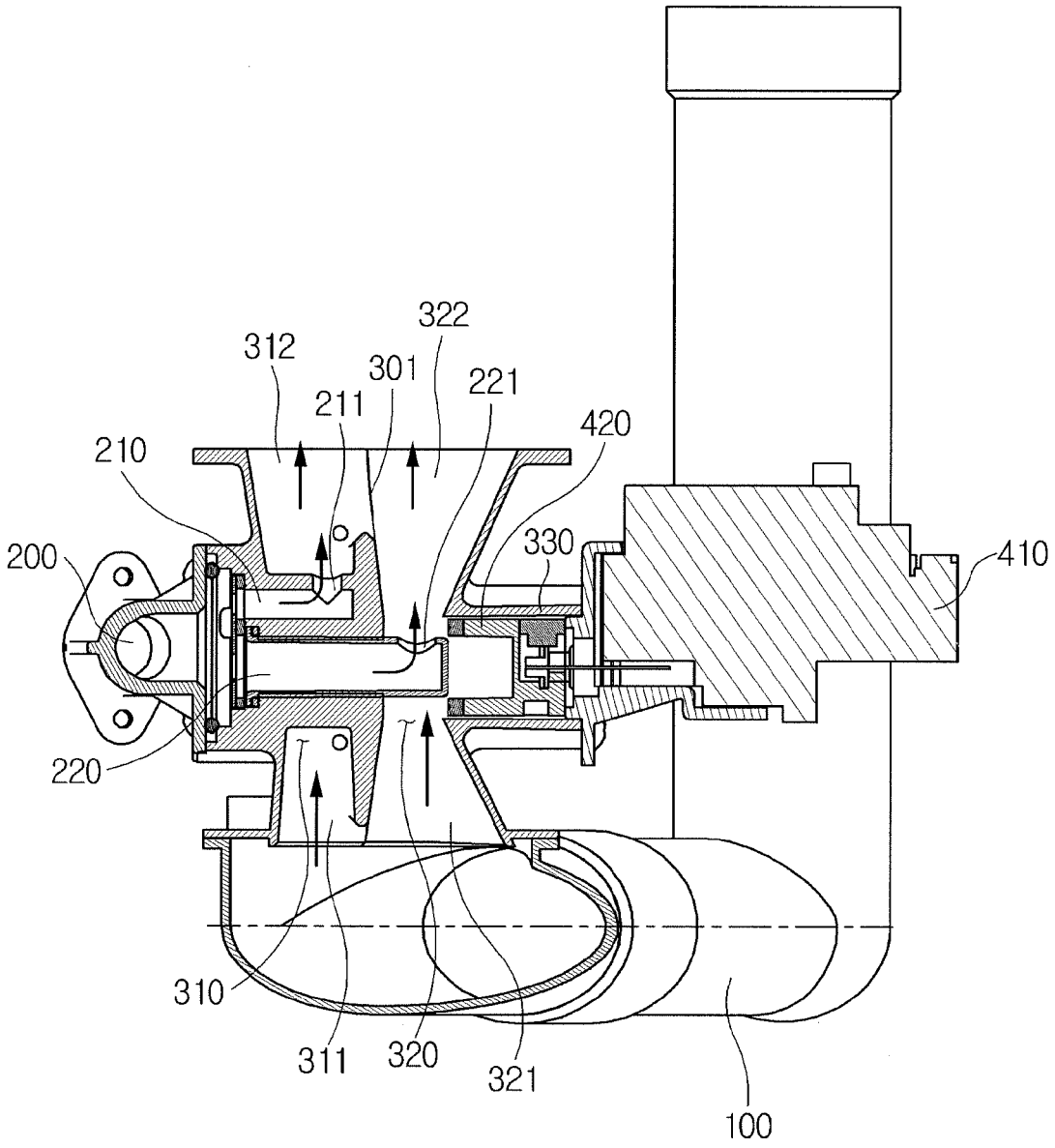
FIG. 3 is a cross-sectional view illustrating an operation state when high thermal energy is used in the combustion device, taken along line A-A of FIG. 1 according to the present invention.

In the present embodiment, the premixing chamber 300 is partitioned into two stages by a partition member 301 that is vertically disposed at a central portion of the premixing chamber 300 in parallel to a flow direction of the mixed gas. Here, a first premixing chamber 310 and a second premixing chamber 320 are disposed at both sides with respect to the partition member 301. Each of the first premixing chamber 310 and the second premixing chamber 320 has the venturi structure. In addition, as illustrated in FIG. 3, each of inlets 311 and 312 and each of outlets 312 and 322 has a wide cross-sectional area, and a central portion between each of the inlets 311 and 321 and each of the outlets 312 and 322 is provided as a throat portion having a minimum cross-sectional area. The cross-sectional area gradually increases from the throat portion toward each of the inlets 311 and 321 and outlets 312 and 322. Since each of the first premixing chamber 310 and the second premixing chamber 320 has the venturi structure, the cross-sectional area may gradually decrease from each of the inlets 311 and 312 to the throat portion. Thus, a flow velocity may increase, and the air may flow at a fast velocity. Also, since the cross-sectional area gradually increases from the throat portion toward each of the outlets 312 and 322, a flow velocity may decrease, and simultaneously, mixing efficiency of the air and gas may be enhanced by a change in pressure.

The combustion gas introduced into the premixing chamber 300 may be regulated in supply amount by a gas control valve (not shown) and then be introduced into the gas supply tube 200. The gas introduced into the gas supply tube 200 is branched into the first gas discharge tube (refer 210 of FIG. 3) and the second gas discharge tube 220.

As a constitution for branching the supplied gas, an orifice 240 having a first nozzle hole 241 for supplying a portion of the gas introduced into the gas supply tube 200 into the first gas discharge tube 210 and a second nozzle hole 242 for supplying the remaining gas into the second gas discharge tube 220 is disposed between the gas supply tube 200 and the premixing chamber 300. An O-ring 230 for maintaining sealing is mounted between the gas supply tube 200 and the orifice 240, and packings 250 having holes 251 and 252 corresponding to the first and second nozzle holes 241 and 242 are inserted between the orifice 240, the first gas discharge tube 210, and the second discharge tube 220. In addition, an O-ring for maintaining sealing is mounted on an end of the second gas discharge tube 220.

The gas introduced into the first gas discharge tube 210 is discharged into a first mixing chamber 310 through a discharge hole 211 formed in the first gas discharge tube 210, and the gas is introduced into the second gas discharge tube 220 is discharged into a second mixing chamber 320 through a second discharge hole 221 formed in the second gas discharge tube 220. In this case, the first discharge hole 211 of the first gas discharge tube 210 and the second discharge hole 221 of the second gas discharge tube 220 may have gas discharge directions toward the outlet 312 of the first mixing chamber 310 and the outlet 322 of the second mixing chamber 320, respectively. Therefore, the flow direction of the air passing through the first and second mixing chambers 310 and 320 and the discharge direction of the gas discharged through the first and second discharge holes 211 and 221 are the same. Accordingly, the gas discharged into the first and second premixing chambers 310 and 320 may not be affected by the air flow to obtain a mixed gas having a precise flow rate at a preset ratio of air and gas.

The first and second gas discharge tubes 210 and 220 are vertically disposed to transversely cross the middle portions of the first and second premixing chambers 310 and 320, respectively. In addition, flow paths of the air passing through the first and second premixing chambers 310 and 320 are defined around the first and second gas discharge tubes 210 and 220, respectively.

Additionally, it is preferable that the first discharge hole 211 of the first gas discharge tube 210 and the second discharge hole 221 of the second gas discharge tube 220 are disposed on the throat portions each of which has the relatively lowest pressure within the first and second premixing chambers 310 and 320 to allow the gas to be smoothly discharged through the first and second discharge holes 211 and 221.

The mixed gas regulation unit 400 may open or close the flow path of the air passing through the second premixing chamber 320 and the discharge path of the gas discharged into the second premixing chamber 320 to regulate a flow rate of the mixed gas. and the mixed gas regulation unit 400 includes a moving block that is reciprocated by a driving unit 410 to open or close the second discharge hole 221 of the second gas discharge tube 220 and the flow path of the air passing through the second premixing chamber 320.

The driving unit 410 supplies a driving force for a forward/backward movement of the moving block. The driving unit may include a step motor or a solenoid. Therefore, the forward/backward movement of the moving block 420 is performed by controlling the number of revolution that is set to the step motor or a signal applied to the solenoid Thus, the forward/backward movement of the moving block 420 may be easily controlled by a simple apparatus.

The moving block 420 include a body 421 having a cross-section corresponding to that of the second premixing chamber 320. A support rod 430 connected to the driving unit 410 is coupled to a support rod insertion hole 422 formed in the body 421 to transmit the driving force of the driving unit 410 into the body 421 of the moving block 420. In addition, a second gas discharge tube insertion hole 423 having a diameter corresponding to an outer circumference of the second gas discharge tube 220 is formed in a central portion of the body 421. Also, a moving block guide unit 330 for guiding the body 421 of the moving block 420 to move forward/backward is disposed in the premixing chamber 300.

Hereinafter, an operation of regulating the flow rate of the mixed gas according to the heating or hot-water load in the combustion device including the above-described constitutions will be described.

Figure 4:
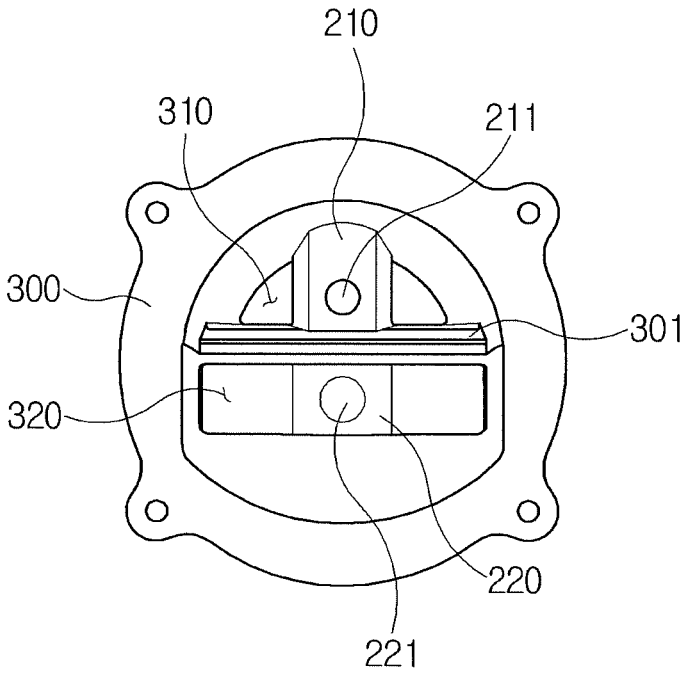
FIG. 4 is a plan view illustrating the operation state when the high thermal energy is used in the combustion device according to the present invention.

FIG. 3 is a cross-sectional view illustrating an operation state when high thermal energy is used in the combustion device, taken along line A-A of FIG. 1 according to the present invention, and FIG. 4 is a plan view illustrating the operation state when the high thermal energy is used in the combustion device according to the present invention.

When high thermal energy at which the heating or hot-water load is relatively large is used, both of the first and second premixing chambers 310 and 320 are opened to mix the air and gas in the first and second premixing chambers 310, 320. In this case, the driving unit 410 of the mixed gas regulation unit 400 is driven so that the moving block 420 moves away from a mixing flow path of the second premixing chamber 320 and is pulled to an inner side of the moving block guide unit 330. Thus, the air introduced into the first premixing chamber 310 and the gas discharged through the first discharge hole 211 are mixed in the first premixing chamber 310, and air introduced into the second premixing chamber 320 and the gas discharged through the second discharge hole 221 are mixed in the second premixing chamber 320. Then, the mixed gas of the air and gas is supplied to a burner (not shown) disposed above the premixing chamber 300. Here, each of flow rates of the air and gas introduced into the air supply tube 100 and the gas supply tube 200 is regulated by controlling the number of revolution of a blower (not shown) and an opening degree of a gas supply valve (not shown) in proportional to the preset heating or hot-water load.

Figure 5:
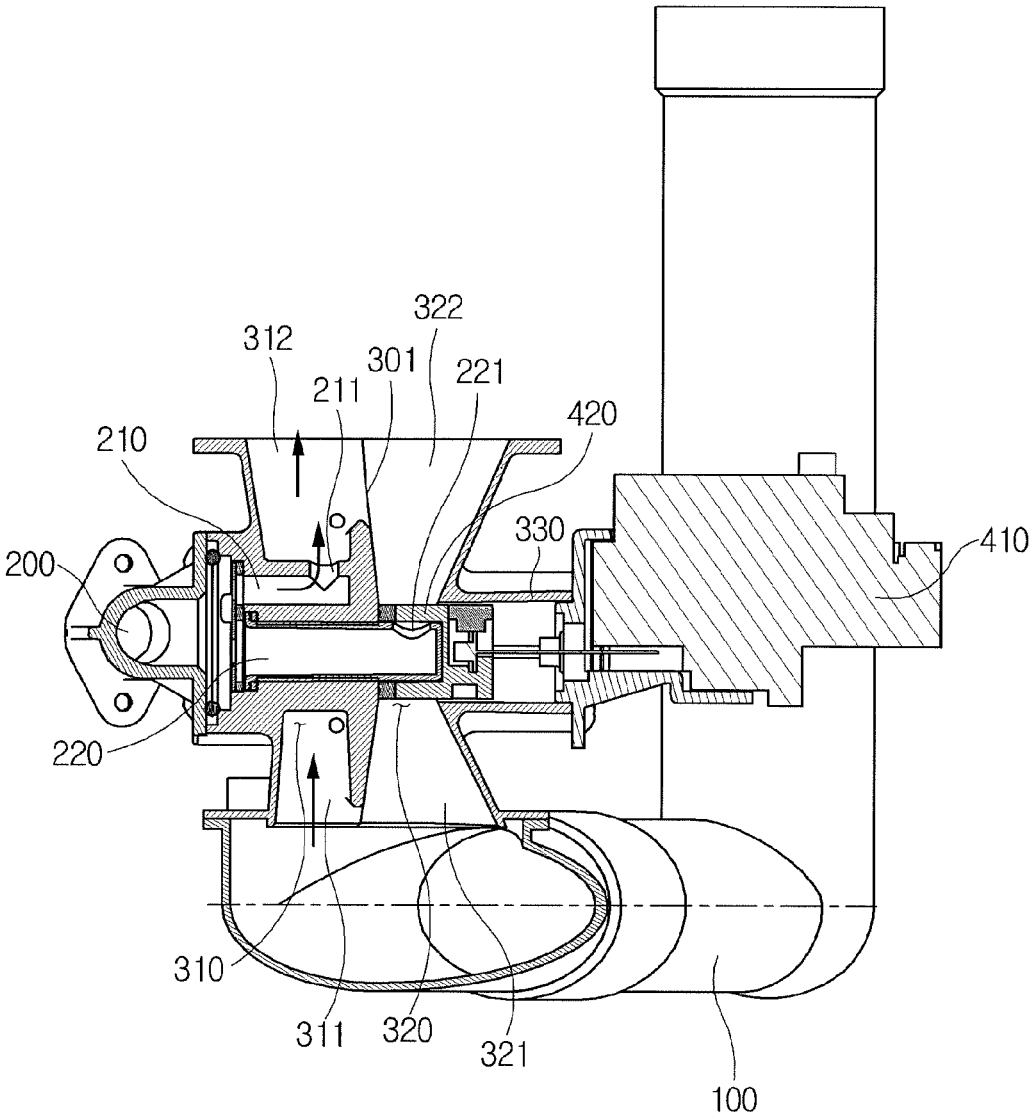
FIG. 5 is a cross-sectional view illustrating an operation state when low thermal energy is used in the combustion device, taken along line A-A of FIG. 1 according to the present invention.
Figure 6:
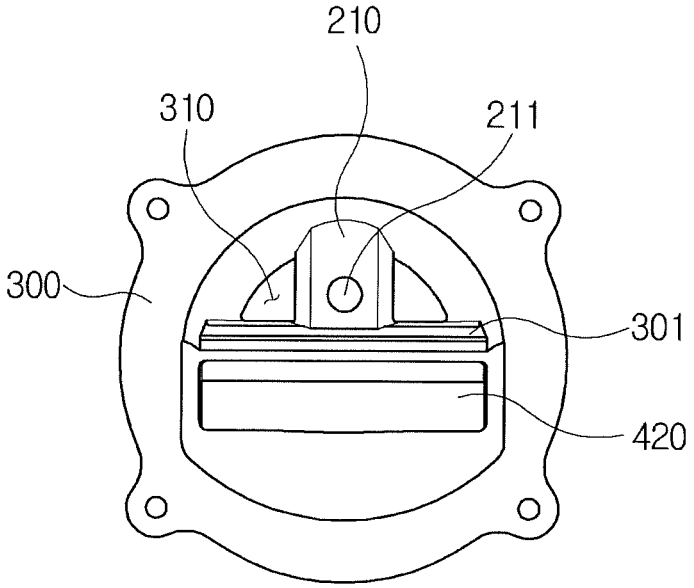
FIG. 6 is a plan view illustrating the operation state when the low thermal energy is used in the combustion device according to the present invention.

FIG. 5 is a cross-sectional view illustrating an operation state when low thermal energy is used in the combustion device, taken along line A-A of FIG. 1 according to an embodiment of the present invention, and FIG. 6 is a plan view illustrating the operation state when the low thermal energy is used in the combustion device according to the present invention.

When low thermal energy at which the heating or hot-water load is relatively small is used, the air flow and gas discharges in the second premixing chamber 320 are blocked, and thus the air and gas are mixed only in the first premixing chamber 310. In this case, the driving unit 410 of the mixed gas regulation unit 400 is driven so that the moving block 420 moves to the mixing flow path of the second premixing chamber 320, and the body 421 of the moving block 420 blocks the second discharge hole 221 of the second gas discharge tube 220 and simultaneously blocks the flow path of the air passing through the second premixing chamber 320.

Accordingly, the air and gas are mixed in only the first premixing chamber 310 in a low load region in which a burner output is low. Also, the flow rate of the air and gas supplied to the air supply tube 100 and the gas supply tube 200 is regulated by controlling the number of revolution of the blower (not shown) and an opening degree of the gas supply valve (not shown) in proportional to the preset load.

As described above, according to the present invention, the premixing chamber 300 is provided in a double structure including the first and second premixing chambers 310 and 320 each of which has the venturi structure. In addition, in the relatively high-output load region, the premixing may be performed in both of the first and second premixing chambers 310 and 320 in consideration of the heating or hot-water load. On the other hand, in the relatively low-output load region, the premixing may be performed in only the first premixing chambers 310, but not be performed in the second premixing chamber 320 to improve the turndown ratio (TDR).

Although the two-staged venturi structure in the premixing chamber 300 is exemplified in the present embodiment, the present invention is not limited thereto. For example, when the premixing chamber 300 is provided with a structure that is designed into two or more multi-stages, the TDR of about 10:1 or more may be obtained.

Also, according to the present invention, the flow direction of the air and the discharge direction of the gas may be the same to minimize a variation in mixing ratio of the air and gas while the second premixing chamber 320 is opened or closed by the movement of the moving block 420, thereby realizing the stable combustion state. Also, since the gas discharge hole is disposed to discharge the gas from the throat portion, the mixed gas having the desired ratio of the air to gas may be generated to improve the combustion efficiency through the complete combustion of the air and gas and to reduce the emission of pollutants.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A combustion device for improving a turndown ratio, the device comprising:

a premixing chamber connected to an air supply tube and a gas supply tube, the premixing chamber having a inner space in which air and gas for combustion are mixed with each other, wherein the inner space of the premixing chamber, in which the air and gas supplied through the air supply tube and the gas supply tube are mixed with each other is divided into a multiple-stage venturi structure, and the gas discharged into the premixing chamber through the gas supply tube is discharged in parallel to a flow direction of the air supplied into the premixing chamber through the air supply tube, the combustion device further comprising a mixed gas regulation unit that opens or closes a portion of the premixing chamber divided into the multiple-stages to regulate a flow rate of a mixed gas of the air and gas, wherein the premixing chamber is divided into two stages to form a first premixing chamber and a second premixing chamber in both sides of a partition member, and the mixed gas regulation unit opens or closes the second premixing chamber through/into which the air passes and the gas is discharged, wherein the gas supply tube is branched into a first gas discharge tube supplying the gas into the first premixing chamber and a second gas discharge tube supplying the gas into the second premixing chamber, and a first discharge hole of the first gas discharge tube and a second discharge hole of the second gas discharge tube are formed so that the gas is discharged toward outlets of the first premixing chamber and the second premixing chamber, wherein the first and second gas discharge tubes are disposed to transversely cross a middle portion of the first premixing chamber and the second premixing chamber, respectively, wherein the mixed gas regulation unit comprises a moving block reciprocated by a driving unit to open or close the second discharge hole of the second gas discharge tube and a flow path of the air passing through the second premixing chamber, wherein the driving unit comprises a step motor or a solenoid.

2. The combustion device of claim 1, wherein a flow path of the air is formed around each of the first gas discharge tube and the second gas discharge tube.

3. The combustion device of claim 1, wherein the first discharge hole of the first gas discharge tube and the second discharge hole of the second gas discharge tube are formed in throat portions in the first premixing chamber and the second premixing chamber, respectively.

* * * * *